US007571842B2

(12) United States Patent
Kishi et al.

(10) Patent No.: US 7,571,842 B2
(45) Date of Patent: Aug. 11, 2009

(54) STAPLE CARTRIDGE

(75) Inventors: Kazuhiko Kishi, Tokyo (JP); Katsuya Hakozaki, Tokyo (JP); Toshio Shimizu, Tokyo (JP); Kazuo Higuchi, Tokyo (JP)

(73) Assignee: Max Co., Ltd., Tokyo (JP)

( * ) Notice: Subject to any disclaimer, the term of this patent is extended or adjusted under 35 U.S.C. 154(b) by 130 days.

(21) Appl. No.: 11/632,309

(22) PCT Filed: Jul. 6, 2005

(86) PCT No.: PCT/JP2005/012498

§ 371 (c)(1),
(2), (4) Date: Jan. 12, 2007

(87) PCT Pub. No.: WO2006/008966

PCT Pub. Date: Jan. 26, 2006

(65) Prior Publication Data

US 2008/0135597 A1 Jun. 12, 2008

(30) Foreign Application Priority Data

Jul. 16, 2004 (JP) ..... 2004-209449

(51) Int. Cl.
*B25C 5/00* (2006.01)

(52) U.S. Cl. ..... 227/120; 227/155; 227/109; 227/134

(58) Field of Classification Search ..... 227/120, 227/155, 109, 134
See application file for complete search history.

(56) References Cited

U.S. PATENT DOCUMENTS 5,038,992 A * 8/1991 Shiang et al. ..... 227/120
5,421,502 A * 6/1995 Huang ..... 227/134
5,779,130 A * 7/1998 Alesi et al. ..... 227/176.1
6,193,126 B1 * 2/2001 Lee ..... 227/83
6,209,772 B1 * 4/2001 Wang ..... 227/134
6,715,654 B2 * 4/2004 Sugihara et al. ..... 227/2

FOREIGN PATENT DOCUMENTS

| | | |
|---|---|---|
| EP | 0 917 936 A2 | 5/1999 |
| EP | 1 473 121 A1 | 11/2004 |
| JP | 55-53506 | 4/1980 |
| JP | 1-146674 | 6/1989 |
| JP | 10-180711 | 7/1998 |
| JP | 2002-079475 | 3/2002 |
| JP | 2003-062765 | 3/2003 |

* cited by examiner

*Primary Examiner*—Brian D Nash
(74) *Attorney, Agent, or Firm*—Morgan, Lewis & Bockius LLP

(57) ABSTRACT

A staple cartridge provided with a cartridge main body and a refill contained with connected staples. The refill is interchangeably attached to the cartridge main body. A guide portion for guiding the connected staples at an inside of the refill to a staple strike out portion is provided between a refill mounting portion and the staple strike out portion. Lower portions of the guide portion and the refill mounting portion are respectively arranged with a first actuator operated in accordance with a presence/absence of the connected staples at an inside of the guide portion and a second actuator provided in accordance with a presence/absence of the connected staples at an inside of the refill mounting portion. The first actuator and the second actuator are interlocked.

7 Claims, 6 Drawing Sheets

STAPLE CARTRIDGE

TECHNICAL FIELD

The present invention relates to a staple cartridge being attached and detached to and from a containing portion of a stapler main body, including a mounting portion for attaching and detaching a refill contained with staples, and including actuators for detecting a presence/absence of the staples respectively to the refill mounting portion and a staple strike out portion.

BACKGROUND ART

In an electric stapler, a staple at inside of a staple cartridge is supplied to a strike out portion and is struck out by a strike out mechanism. Inside of the staple cartridge is contained with connected staples connecting straight staples in a sheet-like shape or a strip-like shape. The sheet-like staples are contained by being laminated in multistages and the strip-like staples are contained by being wound in a roll-like shape.

There is a mechanism of detecting whether connected staples remain in a staple cartridge at a stapler main body as a mechanism for detecting staples (JP-A-2003-062765). Further, there is a detecting mechanism of detecting whether a staple supplied from a staple cartridge is present at a guide portion (JP-A-2002-079475). The former detecting mechanism is constituted by a structure of arranging a sensor for detecting a presence/absence of a staple at a staple guide portion formed between a staple discharge port of the staple cartridge and a strike out portion at a front end of the staple cartridge. According to the latter detecting mechanism, a hole is opened at the staple cartridge itself, and a sensor is operated by vacating the hole by passing a final staple through the hole.

When it is detected that the front end of the staple cartridge reaches a portion of mounting a cartridge main body, a control portion determines that the staple cartridge is mounted to the mounting portion and finishes to prepare a binding operation. When the instruction of the binding operation is issued under the state, the mechanism of striking out the staple is operated.

Meanwhile, there are a staple cartridge which is disposed after consuming up staples at inside thereof and a staple cartridge which is reused. The reused type staple cartridge is constituted such that a refill contained with staples at inside of the case is made to be attachable and detachable to and from a cartridge main body, when all of the staples in the refill have been consumed, only the refill is removed and a separate refill is mounted.

However, although a problem is not posed when the refill is normally mounted to the mounting portion of the cartridge main body in the reused type, when the refill is halfly set (incompletely mounted), the refill is not engaged with a feed claw of a mechanism of feeding out staples in the refill from a guide portion to a strike out portion and therefore, the staples are not fed even when a feed mechanism is operated. Therefore, binding is not carried out after striking out staples remaining in the guide portion.

DISCLOSURE OF THE INVENTION

One or more embodiments of the invention provide a staple cartridge particularly effective in detecting that a refill is halfly set.

A staple cartridge according to one or more embodiments of the invention is characterized by a cartridge main body attached and detached to and from a stapler main body, and a refill contained with connected staples at an inside thereof, the refill is interchangeably attached to the cartridge main body, one end side of the staple cartridge is provided with a mounting portion of the refill, a guide portion for guiding the connected staples in the refill to a strike out portion is provided between the refill mounting portion and the staple strike out portion at other end, a second actuator operated in accordance with a presence/absence of the connected staples at an inside of the refill mounting portion and a first actuator operated in accordance with a presence/absence of the connected staples at an inside of the guide portion are respectively arranged at the lower portions of the refill mounting portion and the guide portion, and the first actuator and the second actuator are interlocked.

According to one or more embodiments of the invention, the second actuator is pivoted around a middle portion in accordance with the presence/absence of the connected staples at the inside of the refill mounting portion, the first actuator is pivoted around a middle portion in accordance with the presence/absence of the connected staples at the inside of the guide portion, the first actuator and the second actuator are aligned in series, and end portions of the first actuator and the second actuator contiguous to each other are connected to be engaged such that by pivoting one thereof, the other thereof is moved interlockingly.

Further, according to one or more embodiments of embodiments of the invention, a staple cartridge is provided with a cartridge main body, a staple strike out portion, a connected staple containing portion provided on one end side, a staple strike out portion provided on the other end side, a guide portion for guiding connected staples at the inside of the connected staple containing portion to the staple strike out portion, a first actuator capable of entering and exiting to and from the guide portion, and a second actuator capable of entering and exiting to and from an inside of the connected staple containing portion. The first actuator and the second actuator are interlocked.

According to one or more embodiments of the invention, the connected staple containing portion is contained with the refill containing the connected staples at an inside thereof and interchangeably attached to the cartridge main body, and the second actuator is made to be able to enter and exit to and from the inside of the refill.

According to one or more embodiments of the invention, the cartridge main body is attached and detached to and from the stapler main body, the first actuator is operated in accordance with a presence/absence of the connected staples at an inside of the guide portion, and the second actuator is operated in accordance with a presence/absence of the connected staples at an inside of the connected staple containing portion.

According to one or more embodiments of the invention, the second actuator is pivoted around a second middle portion, the first actuator is pivoted around a first middle portion, the first actuator and the second actuator are aligned in series, and end portions of the first actuator and the second actuator contiguous to each other are connected to be engaged such that by pivoting one thereof, the other is interlocked.

Further, one or more embodiments of the invention provide connected staples contained in the staple cartridge.

Further, one or more embodiments of the invention provide a refill contained in the staple cartridge.

Further, one or more embodiments of the invention provide connected staples contained in the refill.

Other aspects and advantages of the invention will be apparent from the following description and the appended claims.

BRIEF DESCRIPTION OF THE DRAWINGS

FIG. 5(*b*) is a bottom view showing the state of connecting the first and the second actuators.

Figure 1:
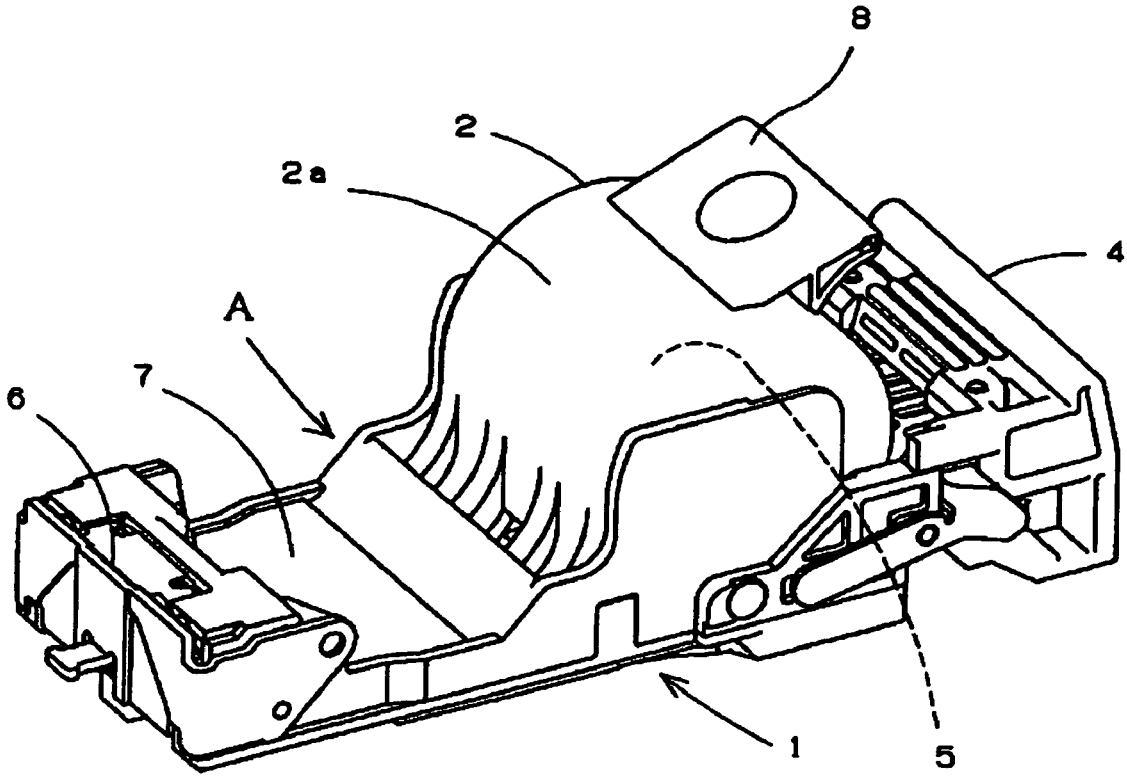
FIG. 1 is a perspective view of a staple cartridge according to one or more embodiments of the invention.

DESCRIPTION OF REFERENCE NUMERALS AND SIGNS a . . . (connected) staples
1 . . . cartridge main body
2 . . . refill
5 . . . refill mounting portion
6 . . . strike out portion
7 . . . guide portion
11 . . . first actuator
12 . . . second actuator

BEST MODE FOR CARRYING OUT THE INVENTION

An explanation will be given of one or more embodiments of the invention in reference to the drawings as follows.

FIG. 1 shows a staple cartridge. The staple cartridge A is constituted by a cartridge main body 1 and a refill 2.

Figure 2:
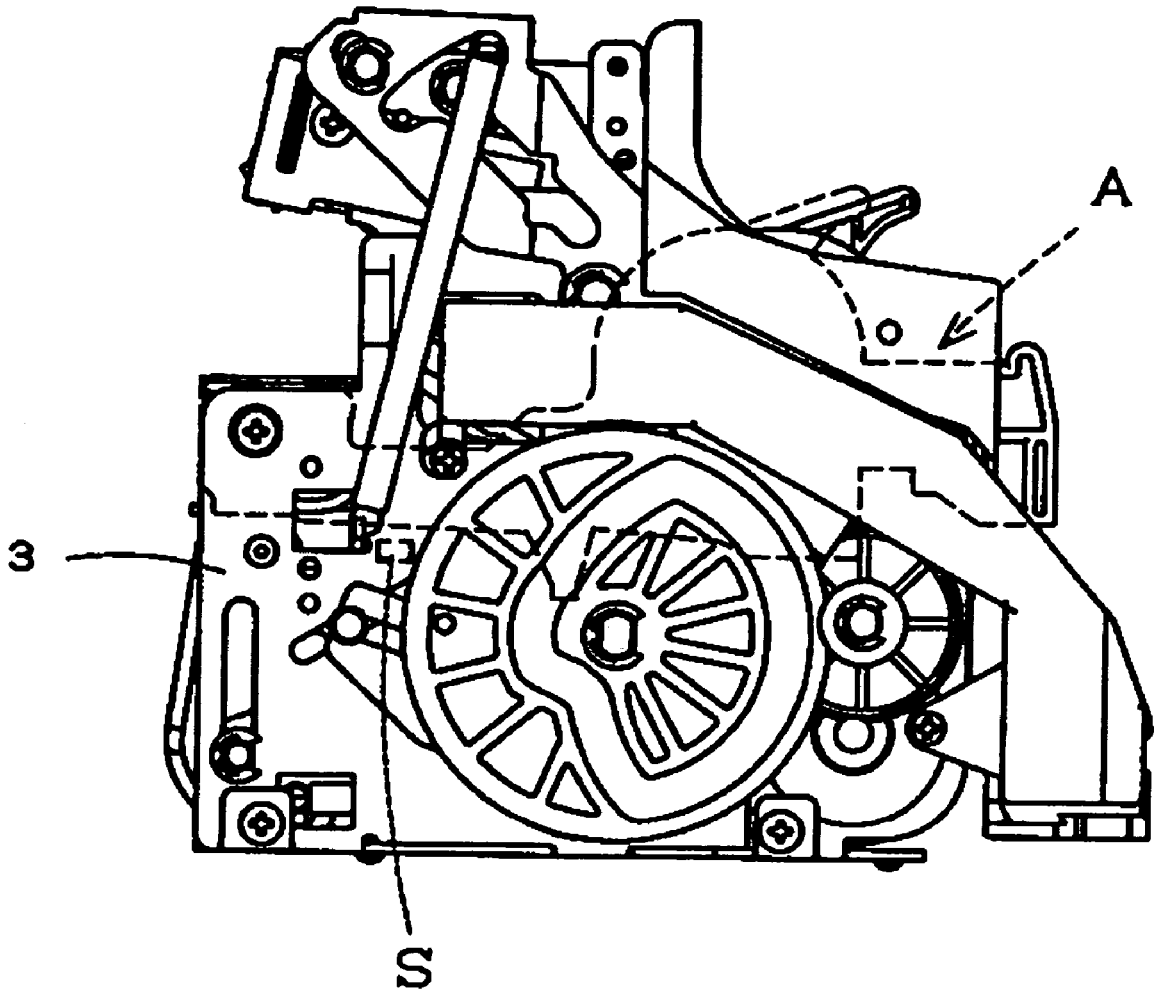
FIG. 2 is a side view of a stapler mounted with a staple cartridge.

The cartridge main body 1 is attached and detached to and from a stapler main body 3 as shown in FIG. 2, a rear end portion thereof is provided with an attachment/detachment operating knob 4, a rear end side thereof is provided with the portion 5 of mounting the refill 2 (connected staples containing portion), and the guide portion 7 for guiding connected staples at inside of the refill 2 to the strike out portion 6 is provided between the refill mounting portion 5 and the staple strike out portion 6 at the other end thereof.

The refill 2 is contained with staples (a) in a roll-like shape at inside of a refill case 2*a*, the refill case 2*a* is formed with a knob 8 on an upper side of a case main body in a cylindrical shape, and formed with a discharge port 9 (refer to FIG. 3) of the staple at one end on a lower side, and the discharge port 9 is for discharging the roll staple and is formed in a shape of a flat square cylinder.

Figure 3:
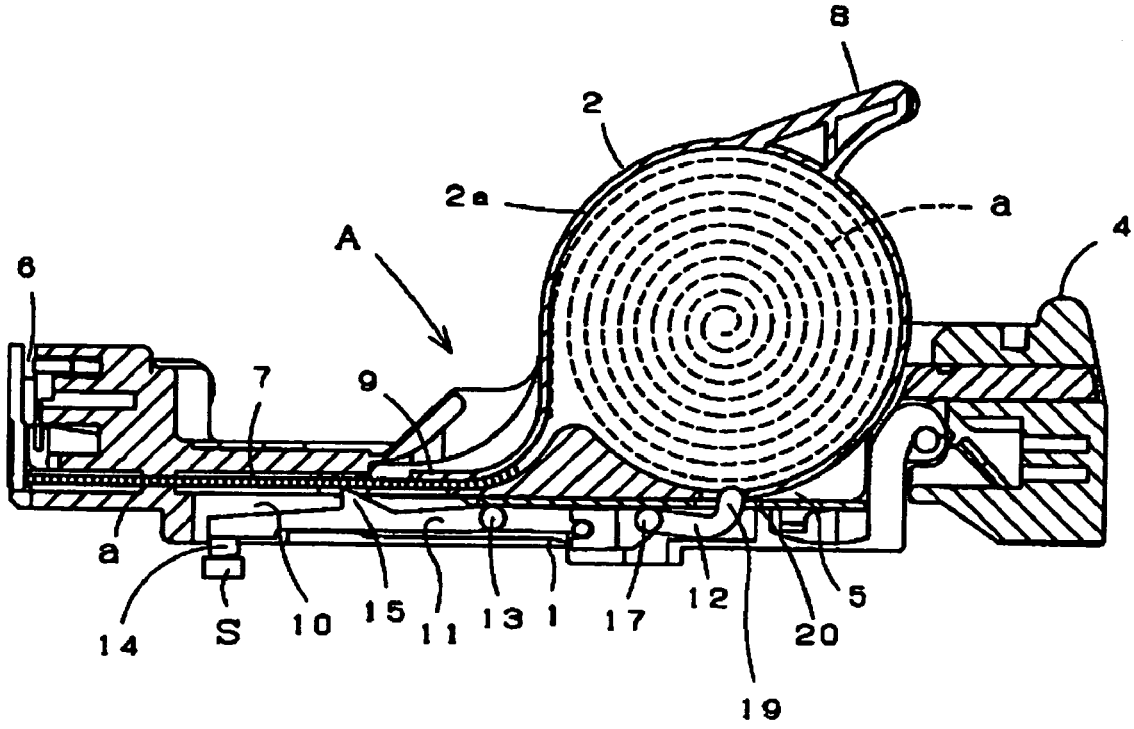
FIG. 3 is a vertical sectional view of a staple cartridge.
Figure 4:
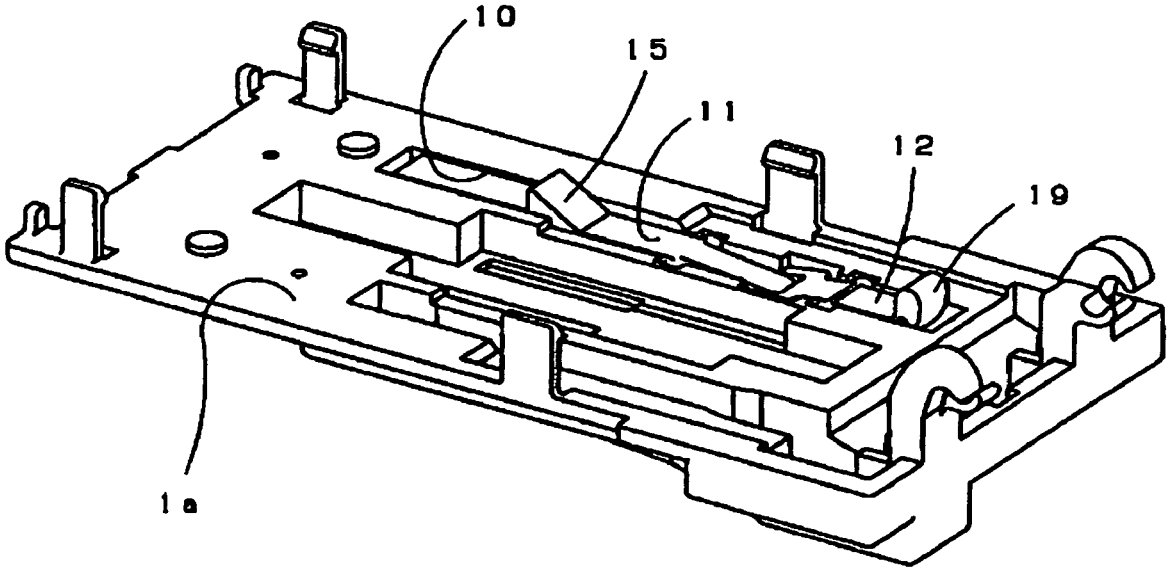
FIG. 4 is a perspective view of a base of a cartridge main body.

Next, as shown by FIG. 3 and FIG. 4, a bottom portion of a base 1*a* of the cartridge main body 1 is formed with a slender opening portion 10 at one side in a width direction thereof. Further, the opening portion 10 is arranged with the first actuator 11 and the second actuator 12 to be arranged in series respectively at lower portions of the guide portion 7 and the refill mounting portion 5.

Figure 5A:
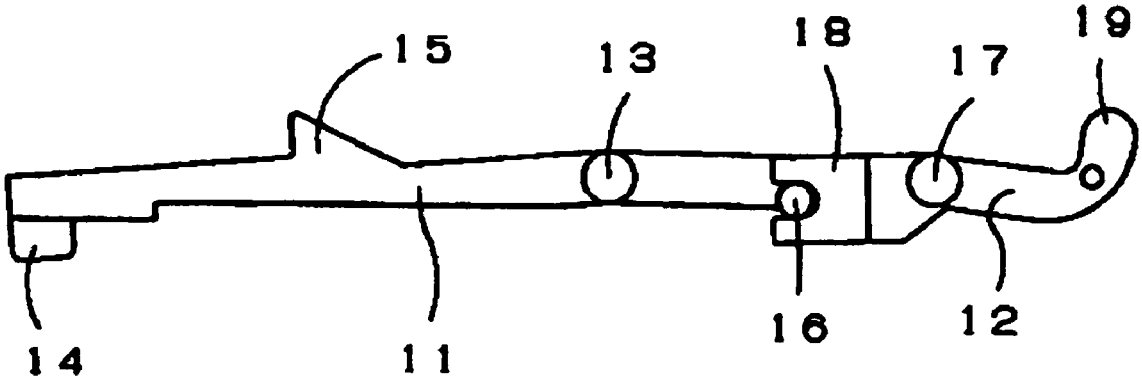
FIG. 5(*a*) is a side view showing a state of connecting a first and a second actuator.
Figure 5B:
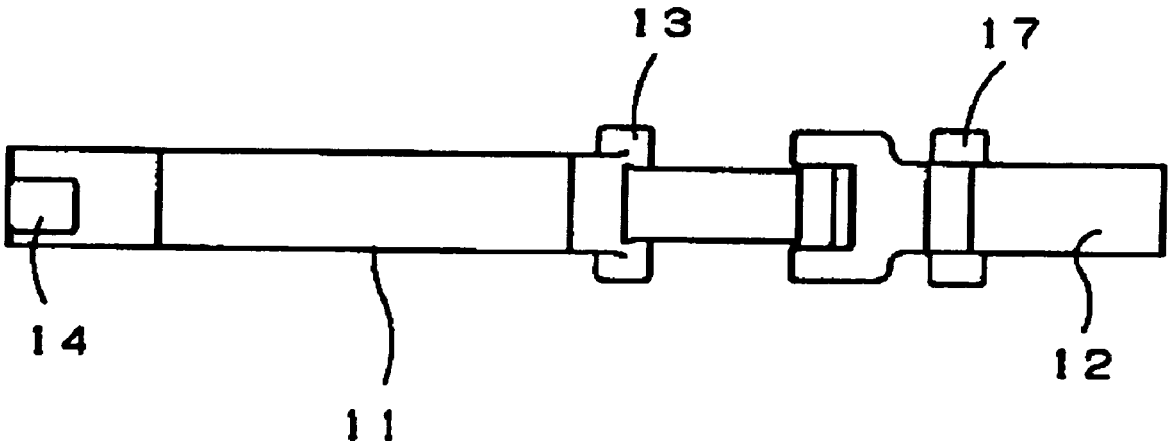

As shown by FIG. 5(*a*) and FIG. 5(*b*), the first actuator 11 is provided pivotably in an up and down direction around a support shaft of a middle portion (first middle portion) 13, formed with a projected portion 14 projected to a lower side at a front end (end portion on a side of the strike out portion 6) thereof, formed with a projected portion 15 in a triangular shape projected to an upper side of a portion thereof in correspondence with the guide portion 7, and formed with a shaft portion 16 at a side of a rear end portion thereof.

Also the second actuator 12 is provided pivotably in the up and down direction around a support shaft of a middle portion (second middle portion) 17 and formed with an engaging groove 18 at a front end portion thereof. Further, a rear end portion thereof is formed with a bent portion 19 projected to an upper side.

The first actuator 11 is arranged so that the projected portion 15 enters and exits to and from the guide portion 7 by being pivoted. By pivoting the second actuator 12, a front end of the bent portion 19 is able to enter and exit to and from an inner side of the case of the refill 2 from a hole 20 (refer to FIG. 3) formed at a bottom portion of the refill case 2*a* of the refill 2 mounted correctly to the mounting portion 5. Therefore, the second actuator 12 is operated in accordance with a presence/absence of the connected staples (a) at an inside of the refill mounting portion 5, and the first actuator 11 is constituted to operate in accordance with a presence/absence of the connected staples at an inside of the guide portion 7.

Next, the rear end portion of the first actuator 11 and the front end portion of the second actuator 12 are connected to engage such that the first actuator 11 and the second actuator 12 are interlocked in the same up and down direction simultaneously with each other by engaging the shaft portion 16 to the engaging groove 18. That is, when one of a free end thereof is moved upward, also a free end of the other thereof is moved upward, and when the free end of the one is moved downward, also the free end of the other is moved downward.

When the staple cartridge A having the above-described constitution is mounted to a predetermined position of the stapler main body 3, the front end projected portion 14 of the first actuator 11 is attached to correspond to a sensor S (for example, relief switch, limit switch) provided at the stapler main body 3 of FIG. 2. Thereby, when the front end projected portion 14 of the first actuator 11 is moved downward, or when the rear end bent portion 19 of the second actuator 12 is moved downward, the sensor S is set to be ON (detect).

Hence, an explanation will be given of how the first actuator 11 and the second actuator 12 are operated in accordance with the presence/absence of the staple at the inside of the staple guide and at the inside of the refill 2 when the staple cartridge A is mounted to the stapler main body 3 as follows.

Figure 6:
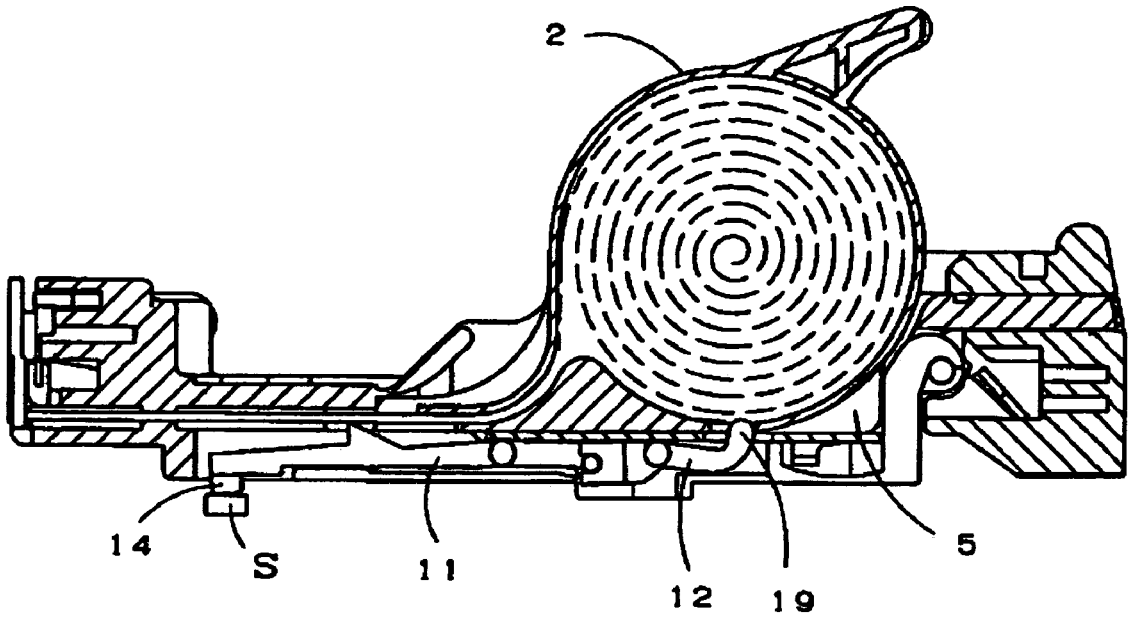
FIG. 6 is a vertical sectional view showing a staple cartridge in a state of normal time.

(1) In interchanging the refill 2 (when there is not staples at insides of the refill 2 and the guide portion 7), as shown by FIG. 6, a new refill 2 is mounted to the refill mounting portion 5, the rear end bent portion 19 of the second actuator 12 is pushed down by the staple of the new refill 2 to move downward. In cooperation therewith, also the front end projected portion 14 of the first actuator 11 is moved downward. Therefore, the sensor S on the side of the stapler main body detects mounting of the refill 2 and preparation of the binding operation is finished.

Figure 7:
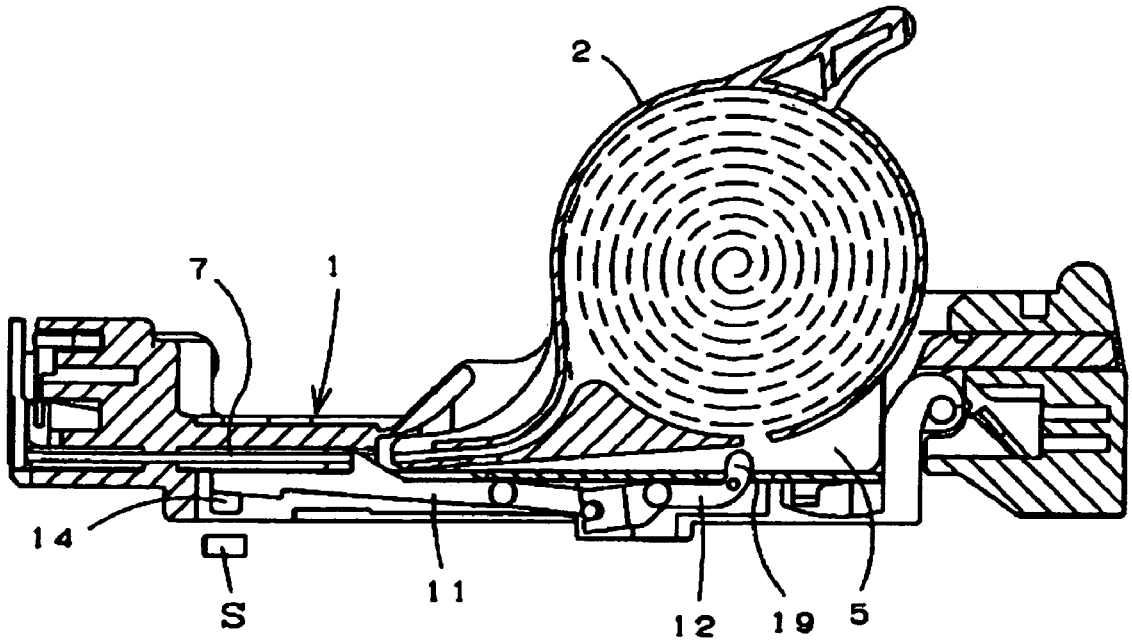
FIG. 7 is a vertical sectional view of a staple cartridge showing a state in half set time.

In contrast thereto, when the new refill 2 is set halfly and is not mounted to the refill mounting portion 5 correctly as shown by FIG. 7, the refill 2 is floated up at the predetermined mounting portion 5, the rear end bent portion 19 of the second actuator 12 is not pushed down by the staple of the new refill 2 and therefore, the rear end bent portion 19 is brought into a state of staying to be moved upward, and also the front end projected portion 14 of the first actuator 11 is maintained at an upper position. Therefore, the sensor S on the side of the stapler main body does not detect mounting of the refill 2, preparation of the binding operation is not finished and therefore, binding cannot be carried out.

(2) At normal time (when staple a is present in the refill 2 and the guide portion 7), as shown by FIG. 3, the staple (a) is present at the guide portion 7 and therefore, the projected portion 15 of the first actuator 11 is pushed down, and the front end projected portion 14 is moved downward. The rear end bent portion 19 of the second actuator 12 is pushed down by the staple of the refill 2 and is moved downward. In this way, the sensor S detects the state in which the staple is present not only in the guide portion 7 but also in the refill 2 and the binding operation can continuously be carried out.

Figure 8:
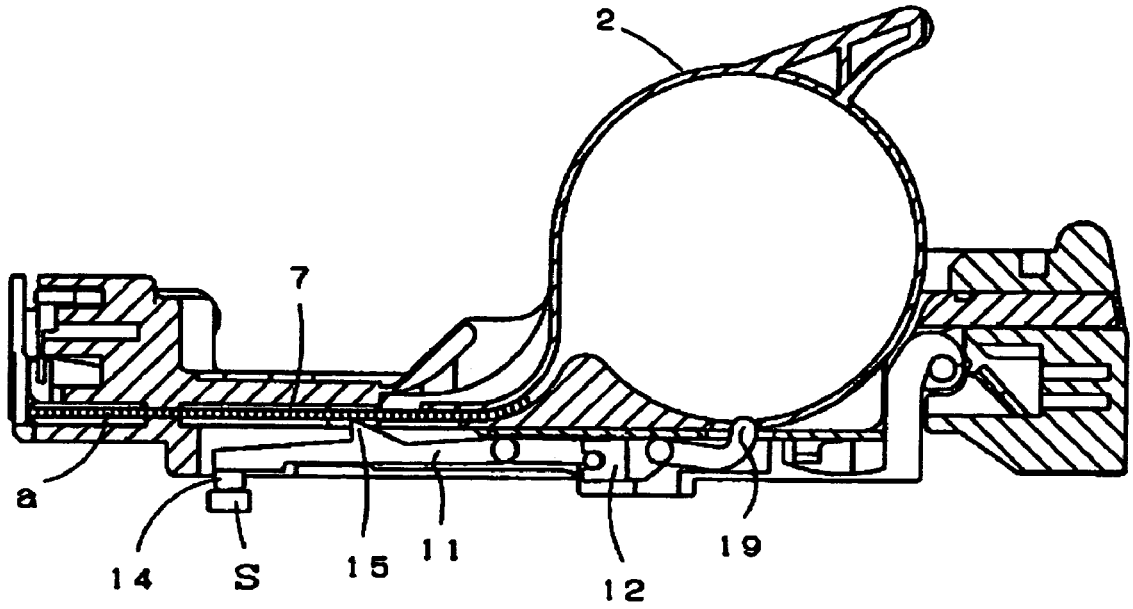
FIG. 8 is a vertical sectional view of a staple cartridge showing a state in which a remaining amount of staples is small.

(3) When a remaining amount of the staple is small (when the staple is not present in the refill 2 but the staple (a) remains at the guide portion 7), as shown by FIG. 8, the staple (a) is present at the guide portion 7 and therefore, the projected portion 15 of the first actuator 11 is pushed down, and the front end projected portion 14 is moved downward. The rear end bent portion 19 of the second actuator 12 is moved downward regardless of the staple remaining amount. In this way, the sensor S detects the state in which the staple remains at the guide portion 7 and the binding operation can continuously be carried out.

Figure 9:
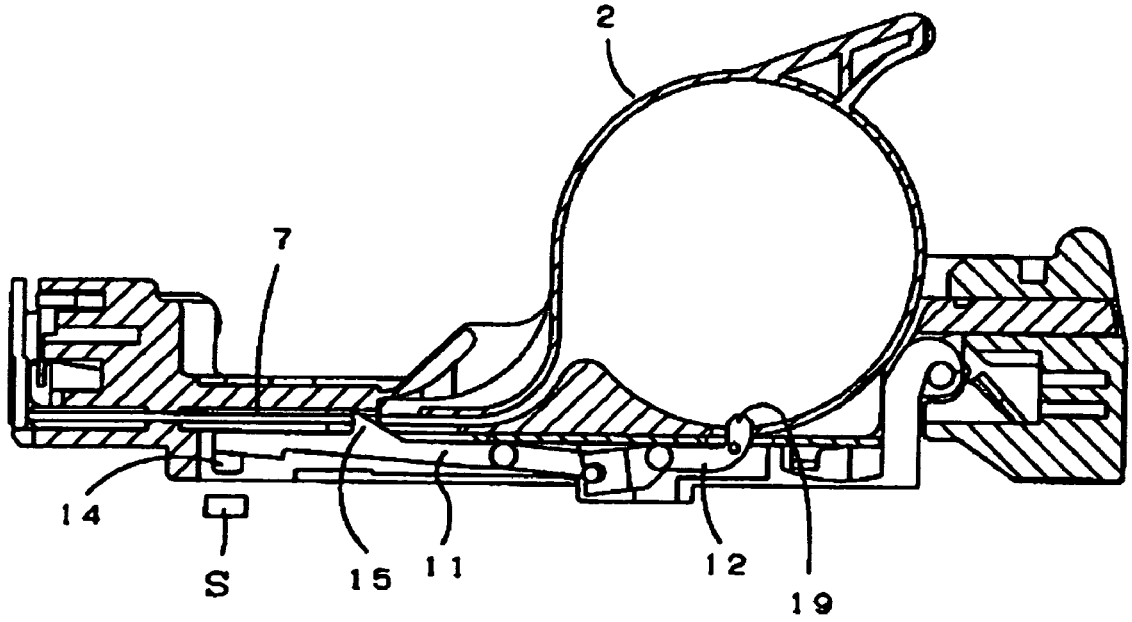
FIG. 9 is a vertical sectional view of a staple cartridge showing a state in which staples are consumed up.

(4) When the staple is consumed up (when the staple does not remain not only in the refill 2 but also in the guide portion 7), as shown by FIG. 9, the front end projected portion 14 of the first actuator 11 is moved upward, and also the rear end bent portion 19 of the second actuator 12 is moved upward. Therefore, the sensor S detects the state in which the staple does not remain not only in the refill 2 but also in the guide portion 7 and the binding operation is stopped.

As described above, when the refill 2 is set to the cartridge main body 1, unless the refill 2 is correctly set to the predetermined position, the second actuator 12 is not operated and therefore, also the sensor S provided on the side of the stapler main body cannot detect the refill 2 and cannot detect presence of the connected staples. Therefore, the binding operation cannot be carried out and therefore, an operator notices the half set state and can correctly reset the refill 2.

Further, the first actuator 11 and the second actuator 12 are aligned in series, end portions of the first actuator 11 and the second actuator 12 contiguous each other are connected to be engaged such that by pivoting one thereof, the other is interlocked and therefore, the sensor S in correspondence with the first actuator 11 or the second actuator 12 may be provided on the side of the stapler main body. Therefore, a number of parts is small and also a structure can be simplified.

Further, as shown by FIG. 2, the staple cartridge A is mounted to the cartridge mounting portion opened at the rear portion of the stapler main body. Although the side of the cartridge main body 1 is provided with a feeding mechanism for feeding out the staple in the staple cartridge to the side of the strike out portion, a forming/striking out mechanism for forming the staple fed to the strike out portion in a C-shape and thereafter striking out the staple, a clincher mechanism of folding to bend a leg portion of the staple struck out by the striking mechanism to penetrate to a sheet on a binding base and so on, since the mechanisms are publicly known, an. explanation thereof will be omitted.

Further, although the above-described example is an example of making the refill 2 mounted with the roll staple attachable and detachable to and from the cartridge main body 1, there may be constructed a constitution of attaching and detaching are fill mounted with a sheet-like staple to and from the cartridge main body.

Although the invention has been explained in details and in reference to specific embodiments, it is apparent for the skilled person that the invention can variously be changed and modified without deviating from the spirit and the range of the invention.

The application is based on Japanese Patent Application (Japanese Patent Application No. 2004-209449) filed on Jul. 16, 2004, and contents of which are incorporated herein by reference.

INDUSTRIAL APPLICABILITY

According to one or more embodiments of the invention, in setting a refill to a cartridge main body, when the refill is not correctly set to a predetermined position, a second actuator is not operated and therefore, also a sensor provided on a side of the cartridge main body cannot detect the refill and cannot detect presence of a connected staple. Therefore, binding operation cannot be carried out and therefore, an operator notices a half set state and can correctly reset the refill. Further, when a first actuator and the second actuator are connected to interlock with each other simultaneously, also the sensor on the side of the cartridge main body may be provided to correspond to either one of the actuators and therefore, there is achieved an advantage of reducing the number of parts and simplifying the structure.

Further, according to one or more embodiments of the invention, the first actuator and the second actuator are arranged to align in series, the contiguous end portions of the first actuator and the second actuator are connected to engage such that by pivoting one thereof, the other thereof is interlocked and therefore, the sensor in correspondence with the first actuator or the second actuator may be provided on the side of the stapler main body. Therefore, the number of parts can be reduced and also the structure can be simplified.

The invention claimed is:

1. A staple cartridge comprising:

a cartridge main body;

a staple strike out portion;

a connected staple containing portion provided on one end side;

a staple strike out portion provided on the other end side;

a guide portion for guiding connected staples at inside of the connected staple containing portion to the staple strike out portion;

a first actuator capable of entering and exiting to and from the guide portion; and a second actuator capable of entering and exiting to and from an inside of the connected staple containing portion;

wherein the first actuator and the second actuator are interlocked, wherein the connected staple containing portion contains a refill that contains connected staples inside thereof and is interchangeably attached to the cartridge main body, and the second actuator is capable of entering and exiting to and from the inside of the refill.

2. The staple cartridge according to claim 1, wherein the cartridge main body is attached and detached to and from the stapler main body, the first actuator is operated in accordance with a presence/absence of the connected staples at an inside of the guide portion, and the second actuator is operated in accordance with a presence/absence of the connected staples at the inside of the connected staple containing portion.

3. The staple cartridge according to claim 2, wherein the second actuator is pivoted around a second middle portion, the first actuator is pivoted around a first middle portion, the first actuator and the second actuator are aligned in series, and respective end portions of the first actuator and the second actuator contiguous to each other are connected to be engaged such that by pivoting one thereof, the other thereof is interlocked.

4. A staple cartridge comprising:

a cartridge main body;

a staple strike out portion;

a connected staple containing portion provided on one end side;

a staple strike out portion provided on the other end side;

a guide portion for guiding connected staples at inside of the connected staple containing portion to the staple strike out portion;

a first actuator capable of entering and exiting to and from the guide portion; and a second actuator capable of entering and exiting to and from an inside of the connected staple containing portion;

wherein the first actuator and the second actuator are interlocked, wherein the second actuator is pivoted around a second middle portion, the first actuator is pivoted around a first middle portion, the first actuator and the second actuator are aligned in series, and respective end portions of the first actuator and the second actuator contiguous to each other are connected to be engaged such that by pivoting one thereof, the other thereof is interlocked.

5. A staple cartridge comprising:

a cartridge main body;

a connected staple containing portion provided on one end side;

a staple strike out portion provided on the other end side;

a guide portion for guiding connected staples at inside of the connected staple containing portion to the staple strike out portion;

a first actuator capable of entering and exiting to and from the guide portion; and a second actuator capable of entering and exiting to and from an inside of the connected staple containing portion;

wherein the first actuator and the second actuator are interlocked, the second actuator is pivoted around a second middle portion, the first actuator is pivoted around a first middle portion, the first actuator and the second actuator are aligned in series, respective end portions of the first actuator and the second actuator contiguous to each other are connected to be engaged such that by pivoting one thereof, the other thereof is interlocked; and connected staples contained in the staple cartridge.

6. A staple cartridge comprising:

a cartridge main body;

a connected staple containing portion provided on one end side;

a staple strike out portion provided on the other end side;

a guide portion for guiding connected staples at inside of the connected staple containing portion to the staple strike out portion;

a first actuator capable of entering and exiting to and from the guide portion; and a second actuator capable of entering and exiting to and from an inside of the connected staple containing portion;

wherein the first actuator and the second actuator are interlocked, the second actuator is pivoted around a second middle portion, the first actuator is pivoted around a first middle portion, the first actuator and the second actuator are aligned in series, respective end portions of the first actuator and the second actuator contiguous to each other are connected to be engaged such that by pivoting one thereof, the other thereof is interlocked; and a refill contained in the staple cartridge.

7. A staple cartridge comprising:

a cartridge main body;

a connected staple containing portion provided on one end side;

a staple strike out portion provided on the other end side;

a guide portion for guiding connected staples at inside of the connected staple containing portion to the staple strike out portion;

a first actuator capable of entering and exiting to and from the guide portion; and a second actuator capable of entering and exiting to and from an inside of the connected staple containing portion;

wherein the first actuator and the second actuator are interlocked, the second actuator is pivoted around a second middle portion, the first actuator is pivoted around a first middle portion, the first actuator and the second actuator are aligned in series, respective end portions of the first actuator and the second actuator contiguous to each other are connected to be engaged such that by pivoting one thereof, the other thereof is interlocked; and connected staples contained in a refill.

* * * * *